United States Patent [19]

Andersson

[11] 4,042,477

[45] Aug. 16, 1977

[54] METHOD OF CONTINUOUS AND DISCONTINUOUS ELECTROCHEMICAL CLEANING OF ALLOYED STEEL WITH SURFACES CONTAMINATED WITH MINERAL OILS AND SYNTHETIC OILS

[75] Inventor: Bengt Ivar Andersson, Karlstad, Sweden

[73] Assignee: C. J. Wennberg AB, Karlstad, Sweden

[22] Filed: May 10, 1976

[21] Appl. No.: 684, 887

[30] Foreign Application Priority Data

May 13, 1975 Sweden .....054791

[52] U.S. Cl. .....204/145 R; 204/144.5

[51] Int. Cl.[2].....C25F1/100; C25F1/06

[58] Field of Search .....204/141.5, 144.5, 145 R

[56] References Cited

U.S. PATENT DOCUMENTS

| | | | |
|---|---|---|---|
| 1,098,338 | 5/1914 | Thompson | 204/144.5 |
| 2,915,444 | 12/1959 | Meyer | 204/145 R |
| 3,429,792 | 2/1969 | Fukui et al. | 204/145 R |
| 3,304,246 | 2/1967 | Fukui et al. | 204/145 R |

FOREIGN PATENT DOCUMENTS

| | | | |
|---|---|---|---|
| 1,082,409 | 9/1967 | Great Britain | 204/145 R |
| 305,036 | 4/1930 | Great Britain | 204/145 R |
| 131,709 | 8/1919 | Great Britain | 204/145 R |

*Primary Examiner*—T. M. Tufariello

*Attorney, Agent or Firm*—Hill, Gross, Simpson, Van Santen, Steadman, Chiara & Simpson

[57] ABSTRACT

The invention relates to a method of continuous and discontinuous electrochemical cleaning of alloyed steel, especially stainless steel in the form of strips, wire, rods, pipe, sections and piece goods with surfaces contaminated with mineral oils and synthetic oils, for example roller oil on cold rolled strips of stainless steel, while preserving or improving the finish. The steel surface is subjected to a combined degreasing and surface degradation by means of a direct current alternating anodic and cathodic electrochemical effect in an aqueous solution containing potassium sulphate with a pH exceeding 10.

10 Claims, No Drawings

METHOD OF CONTINUOUS AND DISCONTINUOUS ELECTROCHEMICAL CLEANING OF ALLOYED STEEL WITH SURFACES CONTAMINATED WITH MINERAL OILS AND SYNTHETIC OILS

FIELD OF THE INVENTION

This invention relates to electrochemical cleaning of steel alloy, the surface of which is contaminated with oil.

PRIOR ART

In the manufacture of products of alloyed steel, for example cold rolled strips of stainless steel, it is necessary that the oil which is used in the rolling and which covers the strip surfaces after rolling be removed before the strip is annealed. This is necessary because residual oil on the strip surfaces can, on the one hand, cause cementation of the strip material resulting in reduced resistance to corrosion and, on the other hand, result in discoloration of the surfaces when annealed by controlled gas annealing as well as annealing in a furnace atmosphere with a certain amount of oxygen present.

The present state of the art as to methods of removing oil from, for example, strip surfaces before annealing does not offer the possibility of completely satisfying the requirements of effective and economical cleaning. For example, cleaning in trichlorethylene is expensive, partly because of the set-up and chemical costs, but primarily because of the devices for ventilation and removal of the injurious gases from the solution. Tests have also shown that the cleaning effect is not always satisfactory if the treatment in trichlorethylene is done without previous removal of moisture from the strip surfaces covered with oil. If moisture is present, a thin practically molecular film of oil can remain on the strip surfaces, which in some cases is sufficient to cause defects when the strip is annealed.

Other known methods include those in which the cleaning is achieved by a combined chemical-physical and mechanical effect, for example through treatment in solutions containing various types of chemical agents with additives of emulsifiers and detergents, in which the cleaning agent is often sprayed onto the strip surfaces and in which the treatment is in certain cases also combined with brushing of the strip surfaces. These methods produce in certain cases an acceptable cleaning, but they are limited in their use, because of, among other things, the long treatment time often required and because of unsatisfactory technical methods for removing the reaction products from the cleaning medium.

It is known that oil can be removed from surfaces of metallic material by electrochemical treatment, so-called electrolytic degreasing.

The conventional processes for electrolytic degreasing, which in and of themselves are effective for cleaning, and which primarily work with strongly alkaline electrolytes with additives of different types of detergents and emulsifiers, have, however, such limitations as to prevent satisfactory technical and economic exploitation of the same, especially for the cleaning of strips, e.g. of stainless steel.

One of these limitations is that the electrolytes which are not continuously regenerated during use have a comparatively short life, and therefore they must be replaced periodically with new fresh electrolytes.

Another limitation of these conventional methods is that they do not allow for the removal of the outermost layer of the cold-worked material surface by controlled surface abrasion degradation) while retaining the surface finish. This is desirable for obtaining completely satisfactory surface purity, since the very outermost layer is deformed and is often also contaminated when being cold-worked.

An additional limitation of these methods is the generally known difficulty of removing strongly alkaline electrolytes from the metal surface after cleaning. It is recommended in these methods therefore that the rinsing operation be combined with a neutralization of the degreased material surface with diluted acid. The reason for this is that the remaining alkali and salts can result in defects in the material surface, especially when it is subsequently annealed or heat treated. The strongly alkaline electrolytes are also unsuitable because of environmental considerations and furthermore involve increased costs to take care of the used electrolytes.

Finally it is pointed out that in the conventional methods it is difficult to fulfill the requirement that the treatment spaces be short, which coincides with the requirement that the treatment times be short for the cleaning process including the rinsing, especially in the cleaning of strips, where the devices for cleaning must be adapted to existing lines for continuous annealing and pickling, where the strip speeds can be up to about 30 m./min. or higher.

SUMMARY OF THE INVENTION

The purpose of the present invention is to remove said limitations and disadvantages in continuous and discontinuous electrochemical cleaning of alloy steel, especially stainless steel in the form of strips, wire, rods, pipe, sections and piece goods with surfaces contaminated with mineral oils and synthetic oils. This is achieved according to the invention by special composition and character of an electrolyte in combination with its reaction mechanisms under electrochemical conditions.

The basic novelty of the method according to the present invention is the introduction of a treatment process combining degreasing and surface degradation, which in a short time completely frees the surfaces of oil while at the same time removes the outermost deformed and contaminated metallic surface layer of the object, resulting in metallically clean surfaces while preserving or improving the finish.

Furthermore an especially economical treatment is made possible due to the fact that the electrolyte, which is of simple composition and is inexpensive, on the one hand regenerates itself by reformation during the process and on the other hand can be freed of oil and metal hydrates precipitated during the process by continuous filtering, resulting in an extremely low consumption of the electrolyte.

Furthermore the short treatment time results in reduced size for the devices with short treatment lines which in combination with the comparatively low energy requirements for the process, makes the method additionally economically valuable.

It is also of economic value that the method according to the invention results in metallically clean surfaces while at the same time preserving or improving the finish, making possible a production and quality increase for the products.

Another essential advantage for the method according to the present invention is that the treatment can be done with closed circulation for the electrolyte, which, in combination with the character of the electrolyte and continuous taking care of the reaction products, oil and metal hydrates, results in essentially complete environmental protection.

In the method according to the present invention the steel surface is subjected to a combined degreasing and surface degradation by means of a direct current alternating anodic and cathodic electrochemical effect in an aqueous solution containing potassium sulphate with a pH exceeding 10.

According to the invention the aqueous solution preferably contains more than 25 g./l. of potassium sulphate, preferably 50–100. g./l., and the aqueous solution containing potassium sulphate has preferably a pH value of 11–13.

In the method according to the present invention a detergent is added to the aqueous solution containing potassium sulphate, preferably in a concentration of 1.0–2.0 g./l., to facilitate the removal of the oil from the steel surface, and to contribute to an improved finish.

The steel surface, which in the method according to the invention is subjected to an alternating anodic and cathodic effect, must assume at least two anode positions and at least two cathode positions, preferably however three anode positions and two cathode positions or more anode-cathode positions, the treatment always being concluded with the steel surface in the anode position to eliminate hydrogen absorption, and to assure complete passivity of the steel surface.

Finally, in the method according to the present invention, the electricity can be supplied to the object to be treated by direct current transmission with pole reversers or by bipolar current transmission.

DESCRIPTION OF THE PREFERRED EMBODIMENTS

In attempts to remove mineral oil from cold-rolled strips of stainless steel by subjecting the steel surface to a direct current alternating anodic and cathodic electrochemical effect in an aqueous solution containing potassium sulphate of pH 12, the surprising advantageous effect was observed that the steel surface after treatment of a few seconds was completely free of roller oil and at the same time the outermost layer was removed from the surface of the strip. This surface degradation, which was evident from the precipitation of metal hydrates, was in itself expected, since the sulfuric acid produced on the strip surface when the strip is in the anode position results in dissolution of material, during the electrochemical process. However the improved finish on the strip was completely unexpected. The surprising effect of the treatment was namely that the strip surfaces had increased brightness and light reflectivity.

To check whether the achieved effect was specific to electrolytes based on an aqueous solution containing potassium sulphate, tests were done with a number of electrolyte combinations of varying concentrations and pH, for example based on sodium salts, magnesium salts and ammonium salts, e.g. sulphates, and mixtures of different sulphates, whereby it was determined that certain electrolytes did not have any cleaning effect at all, while with other electrolytes the roller oil could be removed by depletion, e.g. using an appreciably extended treatment time and/or greatly increased current density. Another disadvantageous effect was that the finish of the strip surface could not be preserved when using the electrolytes tested, since said electrolytes, for example those based on sodium salts, such as sodium sulphate, resulted in a dulling of the surfaces by an etching effect. The addition of various types of inhibitors and luster agents, as well as detergents did not result in any improvement in the finish.

Comparative trials with NaOH and KOH solutions and other strongly alkaline electrolytes did not give the desired result either.

Closer study of the treatment effect when using an aqueous solution containing potassium sulphate, $K_2SO_4$, showed that certain factors were of great importance for fulfilling the requirements of short treatment time and satisfactory surface condition for the strip surfaces.

Tests showed that the electrolyte should contain more than 25 g./l. $K_2SO_4$, suitably 50–100 g./l.

The pH of the electrolyte, which is regulated with KOH and $H_2SO_4$, should be greater than pH, preferably pH 11–13.

The addition of a detergent to the potassium sulphate solution facilitated the removal of the oil from the strip surface and improved the finish. It was found that the preferable quantity of detergent additive was 1.0–2.0 g./l.

The cleansing effect generally increased as the electrolyte temperature increased, but a temperature of 60–70° C. was in most cases quite satisfactory.

The electrical current density could be varied over a relatively large range, depending in part on the thickness of the oil, the treatment time and the desired surface degradation, for example from 10 A/dm.$^2$, with the electrical voltage varying, for example from several volts up to about 20 volts.

However, an electrical current density of 20–30 A/dm.$^2$ was preferable in most cases for the purpose of achieving a satisfactory removal resulting in the required clean, metallic surface.

The number of anode and cathode positions for the strip proved to be of great importance for the results of the treatment. It was found that the steel surface should assume at least two anode positions and at least two cathode positions. Depending on the type of steel, the characteristics of the oil and the thickness of the oil layer, as well as the allowed treatment time, the number of anode and cathode positions for the steel surface can be varied. Generally it is true that the effect is increased by increasing the number of pole reversals. In treating cold rolled strips of stainless steel having thicknesses of 1.0 and 2.0 mm., satisfactory results were achieved with three anode positions and two cathode positions for the strip during a total treatment time of 3–4.5 seconds.

Tests have also shown that exclusively anodic or exclusively cathodic treatment does not produce a sufficient treatment effect.

The treatment time varies depending on the type of steel and the characteristics of the oil in accordance with that stated above regarding anode and cathode positions for the steel surface. It was found that a treatment time of 3–4.5 seconds corresponding to a strip speed of 30–20 m./min. was sufficient for achieving satisfactory results in the cleaning of cold rolled strips of stainless steel, 1.0–2.0 mm. thick.

Satisfactory results can be achieved with direct as well as indirect bipolar electrical current conduction.

In addition to that mentioned previously about the advantages of the method according to the present invention, there is an additional significant advantage, namely the effect of the spontaneous precipitation of metal hydrates, which occurs during the process and which is a part of the self-regeneration process of the electrolyte by reformation of potassium sulphate in the solution. The flocculation of the precipitated metal hydrates apparently has, according to the tests carried out, a positive effect on the bonding of oil in the electrolyte removed from the steel surface and also functions as a filtering agent for taking care of the oil when the reaction products are filtered out of the electrolyte. This allows for a later separation of the oil from the reaction products. The solid reaction products from the electrolyte as well as the oil can of course be destroyed in various ways, for example by burning or roasting.

The method according to the present invention is described in more detail below with reference to the following example from tests carried out with samples from cold rolled strips of stainless steel contaminated with roller oil, which show that the electrochemical treatment results in completely metallically clean surfaces with improved finish.

EXAMPLE

Steel quality: Stainless steel corresponding to AISI: (316). Thickness: 1.0 and 2.0 mm.

Starting surfaces: 1.0 mm. strip, cold rolled with shiny surface; 2.0 mm. strip, cold rolled with duller rougher surface. The surfaces were contaminated with roller oil of a thickness which is usual after cold rolling.

Roller oil: Caltex mineral oil type Rollex 2.2 E°.

Electrolyte: 50 g./l. and 100 g./l. $K_2SO_4$ in aqueous solution with an additive of 1.0 g./l. detergent. Polymin® YTS, a trademark of Badische Anilin & Soda Fabrik, Ludwigshafen, Germany and New York, N.Y.

pH: pH 12.0

Temperature: 70° C.

Electrical current density: 25 A/dm.$^2$

Strip polarity: Three anode positions and two cathode positions.

Treatment time: The treatment time is adjusted to the strip speed according to the table below, which shows the total treatment time at various strip speeds as the treatment is carried out continuously over a treatment line length of 1.5 m. The table also shows the times for the respective anode and cathode positions for the strip.

TABLE

| Strip Speed, m./min. | Treatment Time, Seconds | | |
|---|---|---|---|
| | Total | Anode Position | Cathode Position |
| 30 | 3.0 | 3×0.6=1.8 | 2×0.6=1.2 |
| 20 | 4.5 | 3×0.9=2.7 | 2×0.9=1.8 |

Results: By inspection of the treated samples it was determined that all had completely metallically clean surfaces. The 2.0 mm. strip had satisfactory surfaces with the same treatment times as the 1.0 mm. strip, in spite of the fact that the former had significantly rougher surfaces and therefore a greater total amount of oil.

In measuring the light reflectivity with a glarimeter it was determined that the steel surfaces treated according to the method of the invention had improved finish with increased brightness.

In cleaning wire of stainless steel contaminated with synthetic chlorinated drawing oil, according to the method of the present invention, the same good cleaning effect was obtained as for strips, and short treatment times could also be used.

Finally an additional significant advantage of the method according to the present invention is that the steel surfaces after the electrochemical treatment can easily be completely cleaned, free of electrolyte residue, by merely rinsing in water, because of the moderately alkaline solution and the great solubility of the salt, potassium sulphate, in water.

The test results given here show that the method according to the present invention fulfills those requirements present in continuous and discontinuous cleaning and eliminates said disadvantages and limitations of conventional cleaning processes.

What I claim Is:

1. Method of continuous and discontinuous electrochemical cleaning of alloyed steel, contaminated with mineral oils and synthetic oils while preserving or improving the finish, characterized in that the steel surface is subjected to a combined degreasing and surface degradation by means of a direct current electrochemical treatment in an aqueous solution containing more than 25 g./l. potassium sulphate with a pH exceeding 10, said surface being made alternately anodic and then cathodic.

2. Method according to claim 1, characterized in that the aqueous solution containing potassium sulphate has a pH value of 11–13.

3. Method according to claim 1, characterized in that a detergent is added to the aqueous solution containing potassium sulphate, to facilitate the removal of the oil from the steel surface, and to contribute to an improved finish on the steel surface.

4. Method according to claim 1, characterized in that the steel surface, in the alternating anodic and cathodic electrochemical treatment, is made to assume at least two anode positions and at least two cathode positions, or more anode and cathode positions, the treatment being completed with the steel surface in the anode position to eliminate hydrogen absorption and to achieve satisfactory passivity of the steel surface.

5. Method according to claim 4, characterized in that the number of anode positions of the steel surface is adjusted so that by surface degradation the outermost deformed and contaminated surface layer of the steel surface is removed.

6. Method according to claim 1, characterized in that the electrical conduction to the object which is being treated is done indirectly with bipolar current conduction according to the intermediate conductor process, via pole reversers.

7. A method according to claim 1 in which the aqueous solution contains 50 to 100 g./l. of potassium sulphate.

8. A method according to claim 3 in which the concentration of the detergent is in the range of 1.0 to 2.0 g./l.

9. A method according to claim 4 which includes at least three anode positions and two cathode positions.

10. A method according to claim 1, in which the electrical conduction to the object which is being treated is done directly, with the alternating anodic and cathodic treatment performed by pole reversal via pole reversers.

* * * * *